United States Patent [19]

Witt et al.

[11] 4,144,292

[45] Mar. 13, 1979

[54] DUAL DIAPHRAGM CHOKE ASSEMBLY

[75] Inventors: James L. Witt, Mt. Clemens; Herbert T. LaMore, East Detroit, both of Mich.

[73] Assignee: Colt Industries Operating Corp., New York, N.Y.

[21] Appl. No.: 840,770

[22] Filed: Oct. 11, 1977

[51] Int. Cl.[2] ..... F02M 1/10

[52] U.S. Cl. ..... 261/39 B; 123/119 F

[58] Field of Search ..... 261/39 B; 123/119 F

[56] References Cited

U.S. PATENT DOCUMENTS

| | | | |
|---|---|---|---|
| 2,942,596 | 6/1960 | Carlson | 261/39 B |
| 3,262,683 | 7/1966 | Ball et al. | 261/39 B |
| 3,321,194 | 5/1967 | Carlson | 261/39 B |
| 3,622,131 | 11/1971 | Keenon | 261/39 B |
| 3,814,390 | 6/1974 | Winkley | 261/39 B |
| 3,834,677 | 9/1974 | Hosho | 261/39 B |
| 3,872,847 | 3/1975 | Charron et al. | 261/39 B |
| 3,934,565 | 1/1976 | Matsumoto et al. | 123/119 F |
| 3,962,379 | 6/1976 | Freismuth et al. | 241/39 B |

FOREIGN PATENT DOCUMENTS

| | | | |
|---|---|---|---|
| 2417449 | 10/1975 | Fed. Rep. of Germany | 261/39 B |
| 47-27530 | 12/1970 | Japan | 261/39 B |

*Primary Examiner*—Tim R. Miles

*Attorney, Agent, or Firm*—Walter Potoroka, Sr.

[57] ABSTRACT

A carburetor is shown with a variably openable choke valve operatively connected through linkage means to a related choke valve control assembly having a thermostat, a first vacuum responsive diaphragm and a second vacuum responsive diaphragm; upon initial starting of a cold engine the first diaphragm is effective to move the choke valve to an initial cold engine qualifying position and after the engine attains a preselected temperature the second diaphragm is effective to move the choke valve to a second, more nearly fully opened, qualifying position.

1 Claim, 3 Drawing Figures

DUAL DIAPHRAGM CHOKE ASSEMBLY

BACKGROUND OF THE INVENTION

Because of governmentally imposed regulations relating to automotive engine exhaust emissions and the like, the prior art choke valve control assemblies heretofore proposed have found difficulty in properly controlling the degree of fuel enrichment to the engine during cold start and cold engine drive-away conditions. Further, additional difficulties have been encountered in those situations employing catalytic converters in that in some situations where the cold engine, once started, was permitted to go through its full warm-up range unattended, the catalytic converter becomes overheated because of the overly rich fuel-air mixture being supplied by the carburetor.

Accordingly, the invention as herein disclosed and claimed is primarily directed to the solution of the preceding as well as other related and attendant problems.

SUMMARY OF THE INVENTION

According to the invention, a carburetor for an internal combustion engine comprises a variably positionable choke valve for controlling the flow of air into a related induction passage, thermostatic means operatively connected to the choke valve normally close said choke valve when the engine is cold, first pressure responsive diaphragm means is effective to move said choke valve to a first partly open position upon the cold engine being started, and second pressure responsive diaphragm means is effective to move said choke valve to a second more nearly fully opened position upon the occurrence of a second preselected condition as, for example, the passage of a preselected span of time after the engine has started and/or the attainment of a preselected engine temperature which is less than full normal engine operating temperature.

Various general and specific objects and advantages of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views:

FIGS. 2*a* and 2*b* constitute an exploded perspective view of the elements comprising the choke control assembly of FIG. 1 along with other related or associated elements.

DETAILED DESCRIPTION OF THE PREFERRRED EMBODIMENT

Figure 1:
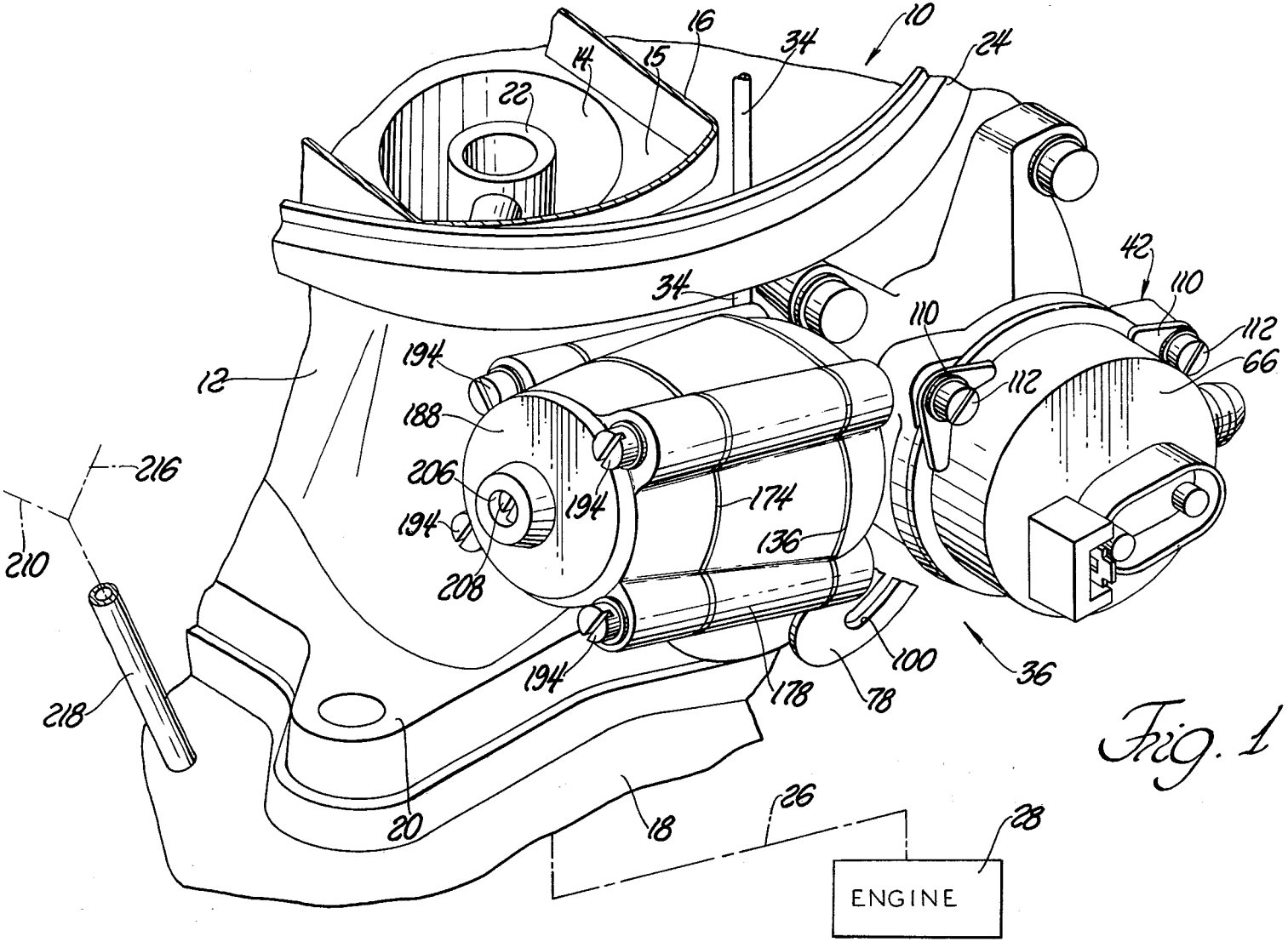
FIG. 1 is a fragmentary elevational view, in perspective, of a carburetor equipped with a choke control assembly employing teachings of the invention.

Referring now in greater detail to the drawings, FIG. 1 fragmentarily illustrates a carburetor assembly 10 having carburetor body means 12 with throttle (not shown) controlled induction passage means 14 formed therethrough as to communicate with an air inlet portion 15 (as bounded by vertically extending wall means 16) and the related inlet of a cooperating engine intake manifold 18 upon which the carburetor body means 12 is suitably situated and secured as by flange means 20. The induction passage means 14 may, of course, be in communication with various fuel metering and discharge means; a main fuel metering discharge nozzle is typically shown as at 22. An annular flange 24 generally circumscribes the air inlet portion 15, vertically upwardly extending wall means 16 and induction passage means 14 and is effective for having mounted thereto associated inlet air cleaner assembly means (not shown). As generally schematically illustrated, the intake passage means 26 of the inlet or intake manifold 18 communicates with the cylinders of the associated engine 28.

A choke valve 30 (not shown in FIG. 1) is suitably, as is well known in the art, pivotally supported by a rotatable choke shaft 32, which may be suitably journalled by the vertically extending wall means 16, as to be rotatable in unison therewith. A choke valve actuating or positioning linkage 34 extends upwardly from the related choke control assembly 36 and passes as through clearance aperture means formed in flange portion 24 in order to be operatively connected at its upper end to lever or arm means 38 fixedly secured to choke shaft 32.

Figure 2A:
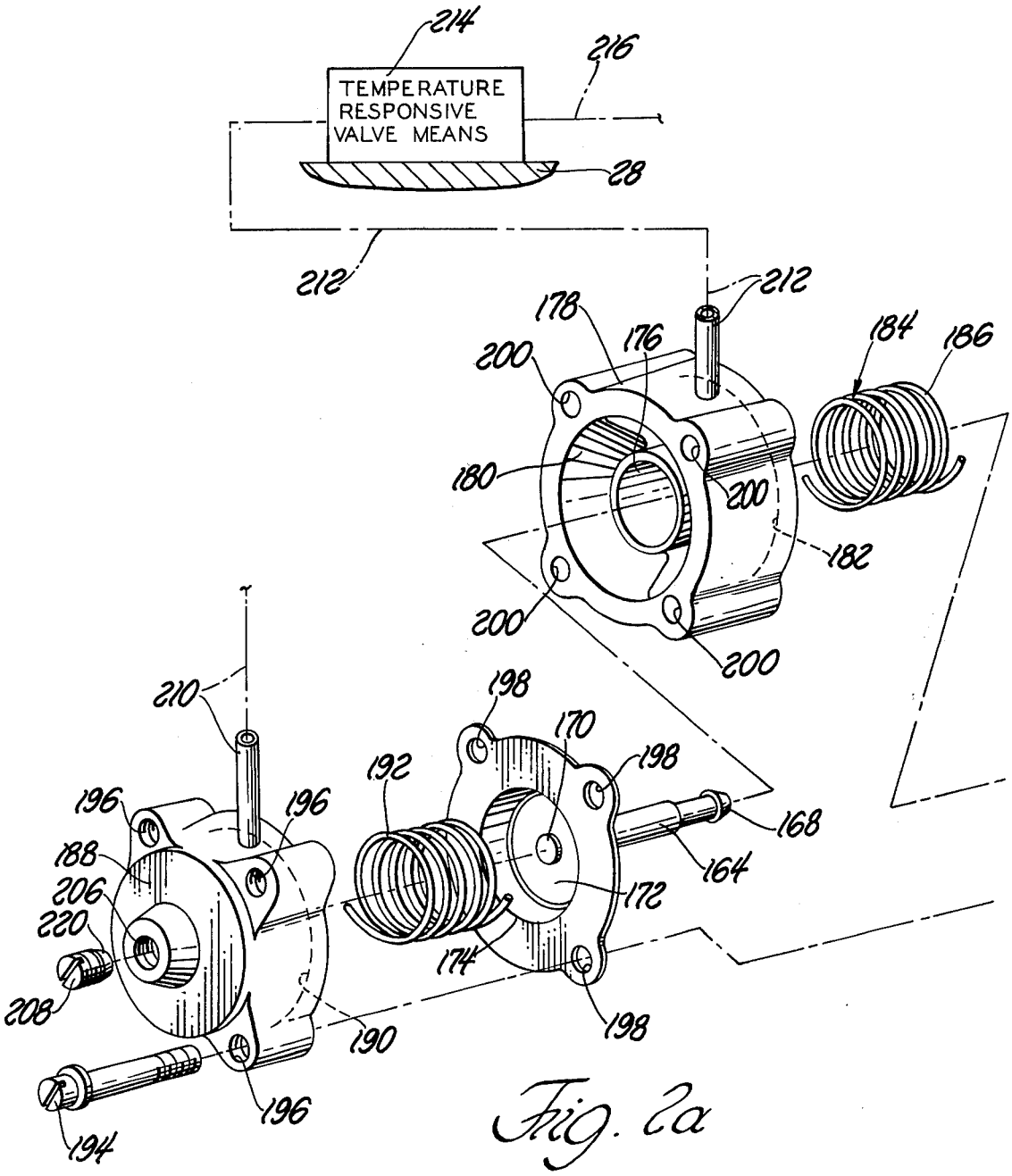
Figure 26:
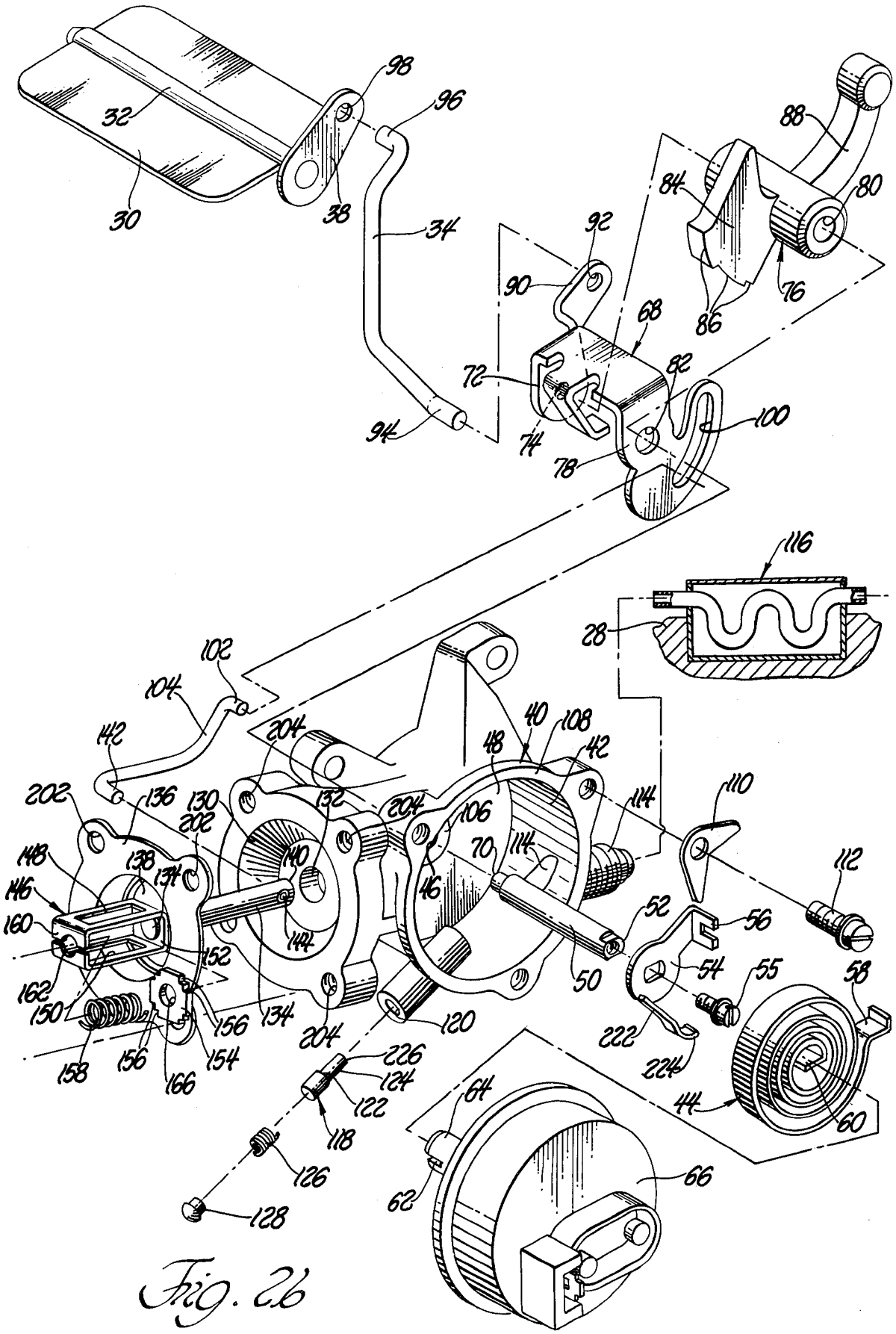

Referring in greater detail to FIGS. 2*a* and 2*b*, the choke control assembly 36 is illustrated as comprising a main housing 40 having suitable flange-like means 42 by which such housing 40 (FIG. 2*a*) may be suitably secured as to carburetor body means 12. A generally cylindrical chamber or recess 42 is formed therein and effective for receiving, at least partially, a related coiled thermostatic element 44. A journal-like passage 46 formed through the inner wall 48 of housing 40 totatably receives therethrough a thermostat lever shaft 50 which, at its inner end 52, is suitably keyed to cooperatingly receive a thermostat lever 54 having a forked arm portion 56 which contains the free movable end 58 of thermostat 44. The lever 54 may be retained to shaft 50 as by a screw 55. The inner end 60 of thermostatic element 44 is fixedly received within a slot 62 of a rod-like mounting portion 64 fixedly carried by a cup-shaped cooperating housing cover member 66.

When assembled, as generally indicated by the centerlines, shaft 50 extends through journal passage 46 as to have most of its length extending beyond the housing 40 and to have a choke control lever 68 received thereon and press-fitted thereto or possibly fixedly secured as by having end 70 of shaft 50 peened onto lever portion 72 generally about aperture 74.

As generally indicated, a fast idle cam member 76 is contained between lever portions 72 and 78 so as to have its clearance passage 80 axially aligned as between aperture 82 in lever portion 78 and aperture 74 in lever portion 72. Accordingly, as shaft 50 passes through apertures 80 and 74 it also passes through fast idle cam passage 80 as to thereby support cam member 76 thereon for relative rotation with respect thereto. As can be seen, cam member 76 has a cam-like portion 84, with peripheral step surfaces 86, and a weighted arm portion 88 continually tending to rotate cam member 76 in a generally clockwise direction as viewed in FIG. 2*b*.

An arm 90 formed on and carried by lever 68 has an aperture 92 for the pivotal reception therethrough of lower end 94 of linkage 34 which has its upper end 96 pivotally retained in and through aperture 98 of choke shaft lever arm 38.

A downwardly depending extension of portion 78 of lever 68 has an arcuate slot 100 formed therethrough which is effective for slidably receiving therein a first end 102 of a linkage member 104.

When, as briefly already referred to, shaft 50 is properly received within journal passage 46 lever 54 is positioned in general juxtaposition to the boss surface 106, generally surrounding passage 46, with thermostatic element 44 axially next situated to lever 54 with end 58 being retained by the forked arm 56. Since the bimetal 44 is carried by housing cover 66, such cover is at that time abutingly held as against surface 108 (or a gasket thereagainst) and may be suitably retained as by a plurality of wing-like retainers 110 and respective cooperating screws 112.

A conduit 114 formed in and carried by housing 40 serves to communicate as between the interior of chamber 42 and a suitable stove means 116 as to supply heated air to the chamber 42 and thermostat 44. The stove means 116 may be situated as at any convenient location of the engine 28 in order to have the air passing through such stove means be heated to a degree which is reflective and indicative of the then engine operating temperature. The actual flow of such heated air in, through and out of chamber 42 may be accomplished in any suitable manner many different ways of which are well known in the art.

A detent or brake member 118, illustrated as being of stepped cylindrical configuration, is slidably received within a passage 120 which may also be stepped as to provide internal abutment means against which shoulder 122 may abut as to thereby permit only a selected length of the reduced portion 124 to extend into chamber 42. A spring 126, also received with such passage 120 serves to yieldingly urge brake or friction member 118 generally towards chamber 42 while a suitable capping or retainer member 128 serves to hold spring 126 and friction member 118 assembled within passage 120.

Housing 40 is also formed as to provide a second chamber-like recess 130 which has a clearance aperture or passage 132 formed through the end wall thereof for freely permitting the passage therethrough of a stem 134 which is fixedly connected at its one end to a flexible pressure responsive diaphragm 136 as by suitable oppositely disposed diaphragm backing plates one of which is shown at 138. When stem 134 passes through aperture 132 its end 140 extends into a space without housing 40 and is in position to then be operatively connected to linkage 104 as by having end 142 thereof pivotally pass through a clearance aperture 144 in stem 134.

A modulator housing or body 146, having opposed open sides and opposed longitudinally extending cutout slot-like portions 148, 150, is also fixedly secured as at its one end 152 to the stem 134 as to be movable in unison therewith. A modulator spring seat 154 is generally caged within housing member 146 as by having pairs of opposed key portions 156 slidably guided with opposed slots 148 and 150. A modulator spring 158 is also situated within housing 146 and generally axially contained as between the inner surface of end 160 of housing 146 and spring seat 154. As shown, end 160 is preferably split and provided with an aperture 162 for the reception therethrough of a second modulator stem 164. Generally, the stem 164 (FIG. 2*a*) passes through aperture 162, through coiled spring 158 and snapped through aperture 166 of spring seat 154 so as to have the annular flange portion 168 of stem 164 abutingly engage the opposite side of spring seat 154. Consequently, spring 158 tends to move stem 164 relative to modulator housing 146 and toward stem 134.

As shown in FIG. 2*a*, the other end 170 of stem 164 is fixedly secured as through suitable diaphragm backing plates, one of which is shown at 172, to a second pressure responsive diaphragm member 174.

While stem 164 is operatively connected to modulator housing 146, as generally already described, it also passes through a clearance passage 176 formed through a housing-like diaphragm spacer 178 which is provided with forward and rearward recesses 180 and 182. A coiled compression spring 184 has one end abutingly received in recess opening 182 of housing 178 and also passes about modulator housing member 146 as to thereby having its other end 186 operatively engaged against diaphragm plate 138. When assembled, stem 164 passes through aperture 162 and spring 158, contained within modulator body 146, and snapped through aperture 166 of spring seat 154 which is also guidingly received within body 146 as by the sliding coaction of slots 148, 150 and keys or tangs 156.

A cover housing member 188 (FIG. 2*a*) having a cavity or recess-like chamber 190 formed in one end thereof receives one end of a coiled compression spring 192 which has its other end operatively engaging diaphragm plate 172.

The various elements are assembled, in the manner described, and retained in such assembled condition as by a plurality of screws, one of which is typically illustrated at 194, passing through apertures 196, 198, 200 and 202 and threadably engaging internally threaded apertures 204. As can be seen, cover housing 188 has a threaded aperture 206 which receives a screw member 208 threadably axially positionable therewithin.

When cover 188 and diaphragm 174 are assembled, a chamber is thereby cooperatingly defined within recess 190 and is in communication with one end of conduit means 210. Similarly, when diaphragms 174 and 136 are assembled onto housing 178 a pneumatically single chamber is defined between diaphragms 136 and 174 with such chamber being in communication with one end of related conduit means 212. The other end of such conduit means 212 is preferably in communication with related valving means 214 which in the preferred embodiment comprises temperature responsive valve means responsive to engine temperature. Other valving means may, of course, be employed as, for example, valving means responsive to the elapse of a predetermined span of time as measured from, for example, the moment at which the related engine is started. Additional conduit means 216 lead from valving means 214 and communicate as with conduit means 218 (FIG. 1) leading to a source of engine vacuum as, for example, the interior of the engine intake manifold 18. Similarly, conduit means 210 is also pneumatically joined to conduit means 218. Even though conduits 210 and 212 have been illustrated as being externally situated, such may, of course, be internally formed as within the body portions of housing sections 188, 178 and 40 as to, when assembled onto the carburetor body 12, communicate with additional conduit means formed internally of carburetor body 12 and communicating with the interior of intake or inlet manifold 18.

OPERATION

Generally, when the engine is cold, the thermostat 44 arm 58 has moved counterclockwise to a maximum position causing a corresponding rotation of lever 54 and shaft 50 resulting in lever member 68, linkage 34 and arm 38 closing choke valve 30. Upon the cold engine being started, engine or intake manifold vacuum is applied via conduit means 218 and 210 to the chamber within recess 190 causing modulator diaphragm 174 to move to the left, against the resilient resistance of spring 192, until plate 172 or end 170 of stem 164 abuts against the inner end 220 of adjustable stop screw 208.

The movement of diaphragm 174 and stem 164 in turn causes, through spring perch 154 and spring 158, leftward movement of modulator body 146, and stem 134 which is secured thereto as at end 152 of modulator body 146. Such leftward movement of stem 134 in turn causes similar movement of linkage 104 which, being operatively engaged in bean slot 100, causes a corresponding clockwise rotation of lever member 68 resulting in the downward movement of linkage 34 and an opening movement of choke valve 30. Such an initial opening position of the choke valve 30 is often referred to as a low temperature qualifying position.

As engine temperature increases, the modulator spring 158 continues to oppose the thermostatic spring force and in so doing further opens and varies the position of the choke valve 30 as to thereby match the then existing requirements for engine fuel enrichment. In the preferred embodiment, at approximately 70° F. engine temperature, the choke closing force of thermostatic spring 44 has further lessened and modulator spring 158 has served to further open choke valve 30 to a position where it may be in the order of 30° from being fully open (such fully opened choke position often being referred to as the high temperature qualifying position).

In the preferred embodiment the choke valve 30 will remain in its position 30° away from fully opened until engine temperature reaches a magnitude of approximately 90° F. At this time, preferrably, valve means 214 opens permitting engine vacuum to be communicated via conduit means 212 to the housing 178 between diaphragm 174 and 136 thereby in effect neutralizing the force generated by the previously applied vacuum to the other side of diaphragm 174. However, the application of such vacuum against the quick-pull diaphragm 136 causes the diaphragm 136 to move to the left and in so doing, through the linkages and levers previously referred to, further open choke valve 30 a position where, in the preferred embodiment, it is approximately 10° away from being fully opened. At the same time, fast idle cam member 76 is rotated clockwise so as to present its lowest cam steps of surfaces 86 thereby providing for a low fast idle engine speed. Two functions are achieved by this action. That is, the choke valve 30 being in the said 10° away from fully open position is actually in a non-enrichening position and thereby provides protection against the related engine exhaust gas catalytic converter becoming overheated due to excessive fuel enrichment while the positioning of the fast idle cam member 78 into its low speed fast idle position provides stable engine idling and improved vehicle driveability when the non-enriched fuel mixture condition (as determined by the choke valve 30) exists.

It should be noted that in the preferred embodiment, thermostat lever 54 also carries an arm 222 with a foot-like portion 224. When the quick-pull diaphragm 136 is actuated as already described and pulls the choke valve to its said 10° position, foot 224 is swung and frictionally, in a detent-like manner, engages end 226, of stop member 118, which protrudes into chamber 42 of housing 40. This, in effect, results in a prolonged engine low speed fast idle. That is, the choke 30 and fast idle cam member 76 will remain in the said 10° position to which they were moved by quick-pull diaphragm 136 while the engine continues to increase in temperature. As the thermostatic spring accordingly continues to increase in temperature the spring force thereof tending to close the choke valve continues to diminish and ultimately starts to increase in the opposite direction. When such oppositely directed force attains a sufficient magnitude, foot portion 224 is forced past detent member 118, as by the attendant compression of detent spring 126, thereby fully opening the choke valve 30 and allowing the fast idle cam 76 to move completely out of the path of the related movable throttle stop member (not shown but well known in the art) and thereby providing for a normal engine idle.

Although only a preferred embodiment of the invention has been disclosed and described, it is apparent that other embodiments and modifications of the invention are possible within the scope of the appended claims.

I claim:

1. A choke control assembly for a choke valve of an internal combustion engine carburetor, comprising linkage means connectable to said choke valve for variably positioning said choke valve from a fully closed position to a fully opened position, resilient thermostatic means operatively connected to said linkage means, said thermostatic means being responsive to engine temperature and effective when said engine is below a predetermined minimum temperature for causing said linkage means to move as to fully close said choke valve, first and second pressure responsive movable wall means operatively connected to said linkage means, conduit means for communicating engine vacuum from a source of vacuum generated by said engine to said first and second pressure responsive wall means, said first pressure responsive wall means being effective upon said engine being started to move said linkage means as to thereby cause said choke valve to move to a first partially opened position, said second pressure responsive wall means being effective upon the occurrence of a second indicium of engine operation after said engine has been started to move said linkage means as to thereby cause said choke valve to move to a second partially opened position more nearly fully opened than said first partially opened position, and resilient means effective when said choke valve has attained said first partially opened position to resiliently oppose said thermostatic means and tend to further open said choke valve from said first partially opened position, said first and second pressure responsive wall means being arranged in tandem relationship to each other, and said resilient means forming an operative connection therebetween.

* * * * *